United States Patent [19]

Blackburn

[11] Patent Number: 5,037,092

[45] Date of Patent: Aug. 6, 1991

[54] APPARATUS FOR MOUNTING A BASKETBALL RIM TO A GLASS BASKETBALL BACKBOARD

[76] Inventor: Michael J. Blackburn, 505 E. Washington St., Morris, Ill. 60450

[21] Appl. No.: 492,191

[22] Filed: Mar. 13, 1990

[51] Int. Cl.[5] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 1,702,510 | 2/1929 | Jones | 273/1.5 R |
| 1,757,350 | 5/1930 | Wallace | 273/1.5 R |
| 3,462,143 | 8/1969 | Bidelman et al. | 273/1.5 R |
| 4,285,518 | 8/1981 | Pearo | 273/1.5 R |
| 4,433,839 | 2/1984 | Simonseth | 273/1.5 R |
| 4,588,188 | 5/1986 | Mahoney et al. | 273/1.5 R |
| 4,895,365 | 1/1990 | Schroeder | 273/1.5 R |

*Primary Examiner*—Paul E. Shapiro

*Attorney, Agent, or Firm*—Ernest Kettelson

[57] ABSTRACT

An apparatus for mounting a basketball rim to a glass basketball backboard to prevent a basketball rim from being torn from and thereby shattering the backboard. A small portion of a glass backboard normally supporting a basketball rim, is removed and replaced with a rim mounting plate. The rim mounting plate is joined between two horizontal support tubes that connect to a support frame that attaches to the perimeter of the glass backboard. A support bracket assembly is connected to both the rim mounting plate and the glass backboard to secure the assembled rim and backboard to a support pole.

6 Claims, 6 Drawing Sheets

APPARATUS FOR MOUNTING A BASKETBALL RIM TO A GLASS BASKETBALL BACKBOARD

BACKGROUND OF THE INVENTION

This invention relates to the field of basketball goals, and in particular to basketball goals having a glass backboard that supports a basketball rim and provides a mounting surface for securing the rim and backboard to a support structure.

Prior art basketball goal designs have been aimed at providing adjusting means to vary the height of a basketball goal. No basketball goal design has addressed the problem of reinforcing a glass basketball backboard to prevent a rim from being torn from the backboard. When the rim is torn from the backboard, the backboard shatters and deposits glass particles over a broad area thereby causing a safety problem and delaying the basketball sporting event.

The problem with prior art basketball goals is that the rim is bolted directly to the backboard. This arrangement is utilized even with the backboard manufactured from glass. A common scoring technique in basketball is for a player to ram the ball through the rim for an easy score and then hang or pull on the rim for a brief period of time after the ball passes through the rim. The player hanging or pulling on the rim can tear the rim from the glass backboard thereby causing the entire backboard to shatter and the rim to be propelled downward towards the player.

Examples of prior art devices include those disclosed in the following United States Patents:

Pat. No. 4,805,904 discloses an adjusting assembly connected to a basketball backboard and mounting post. The adjusting assembly utilizes two parallel support members having one end pivotally connected to a rigid vertical support attached to the backboard, and an opposite end pivotally connected to a support pole. A locking mechanism is connected to both parallel support members thereby maintain the position of the support members and the backboard height of the basketball backboard. The problem with this device is that the basketball rim is bolted to the backboard, and if a glass backboard is utilized with the adjusting assembly, there is the possibility that the rim could be torn from the backboard thereby causing the backboard to shatter and deposit glass particles in the proximate area.

Pat. No. 4,801,142 discloses an adjustable basketball goal with a lift cable and winch for raising and lowering the basketball goal. The cable has a height indicator assembly thereon for indicating the height of the basketball hoop above the playing surface. The support structure for the basketball goal includes a safety cylinder to prevent rapid descent of the backboard thereby avoiding injuries.

Pat. No. 4,526,367 discloses a portable basketball goal that collapses into a lowered position thereby permitting storage in a conventional garage; also, the goal may be wheeled to a desired location and elevated to a playing height.

Pat. No. 3,722,886 discloses a movable stand for a basketball goal having an elongated tube with a basketball goal mounted at one end, means to secure the tube at the opposite end, and a movable carriage supporting the tube at the mid-portion. A winch mechanism is provided to raise and lower the basket and backboard, and backboard adjustment means are provided to position the backboard vertical with respect to the ground as the height is varied.

Pat. No. 3,586,324 discloses a vertically adjustable basketball goal having upper and lower pairs of parallel arms which are pivotally connected to a support thereby allowing the goal to be vertically adjusted by means of a flexible cable passing over a pulley positioned on the top of the support.

Pat. No. 2,881,003 discloses a device for raising and lowering basketball backboards. The device includes upper and lower pairs of support members pivotally connected at one end to a gymnasium wall and pivotally connected at the opposite end to a basketball backboard. A winch assembly is mounted to the gymnasium wall below the support members. A cable from the winch assembly extends upward through a pulley mounted to the gymnasium wall above the support members. The cable then extends downward to the basketball backboard and is connected thereto. This arrangement allows the basketball goal to be elevated upwards and against the gymnasium wall.

SUMMARY OF THE INVENTION

It is an object of this invention to provide an apparatus for mounting a basketball rim to a glass backboard thereby preventing the backboard from shattering when a basketball player pulls or hangs on the rim.

It is an object of this invention to provide an apparatus for mounting a basketball rim to a glass backboard with the rear wall of the backboard having a support frame mounted thereto.

It is an object of this invention to provide an apparatus for mounting a basketball rim to a glass backboard with the glass backboard having a cut out portion where the basketball rim is normally connected.

It is an object of this invention to provide an apparatus for mounting a basketball rim to a glass backboard with a glass backboard having a cut out portion to receive a basketball rim mounting plate to support a basketball rim with the mounting plate connected to the support frame.

It is an object of this invention to provide an apparatus for mounting a basketball rim to a glass backboard with support means to support the backboard and rim assembly at an elevated height above a playing surface.

DESCRIPTION OF PREFERRED EMBODIMENT

Figure 1:
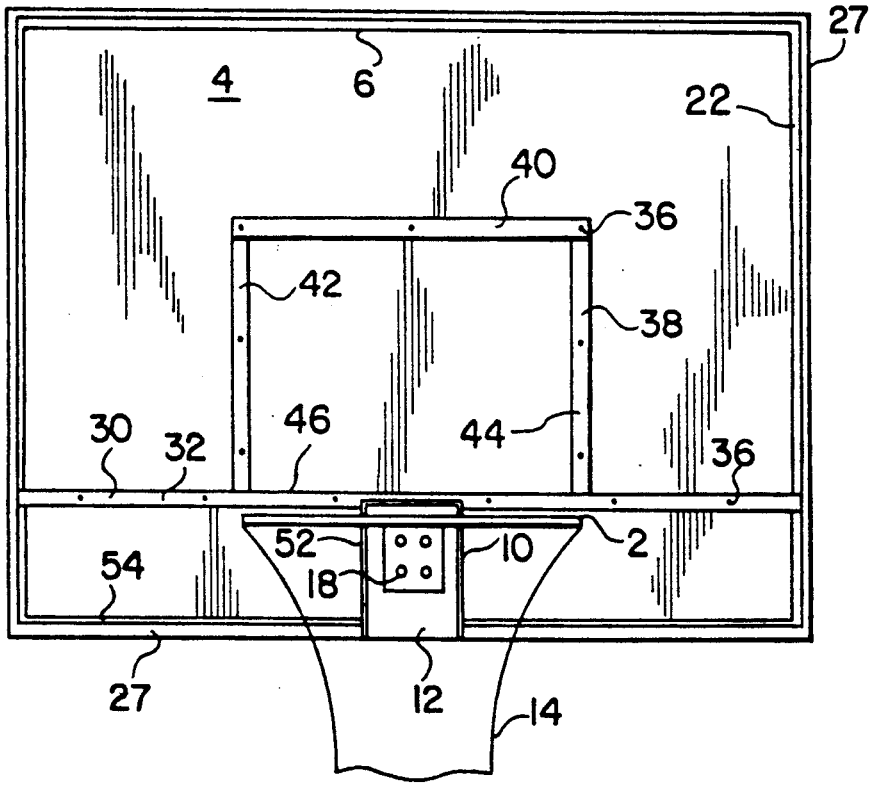
FIG. 1 is a front elevation view of a glass basketball backboard, basketball rim, and basketball rim mounting plate in accordance with this invention.
Figure 2:
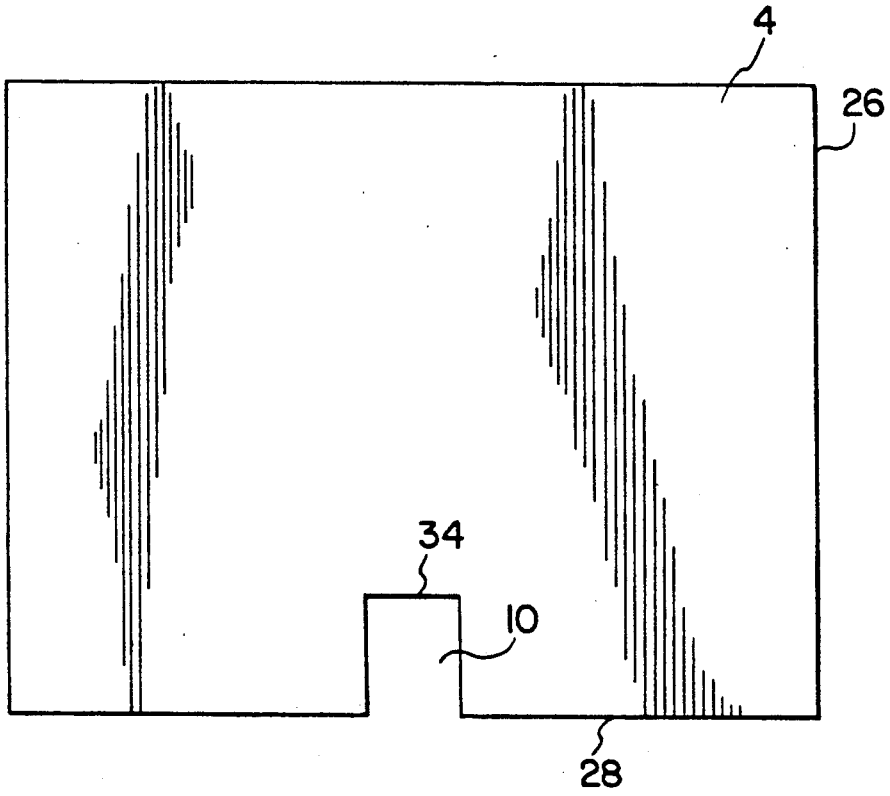
FIG. 2 is a front elevation view of a glass basketball backboard with a cutout portion in accordance with this invention.
Figure 3:
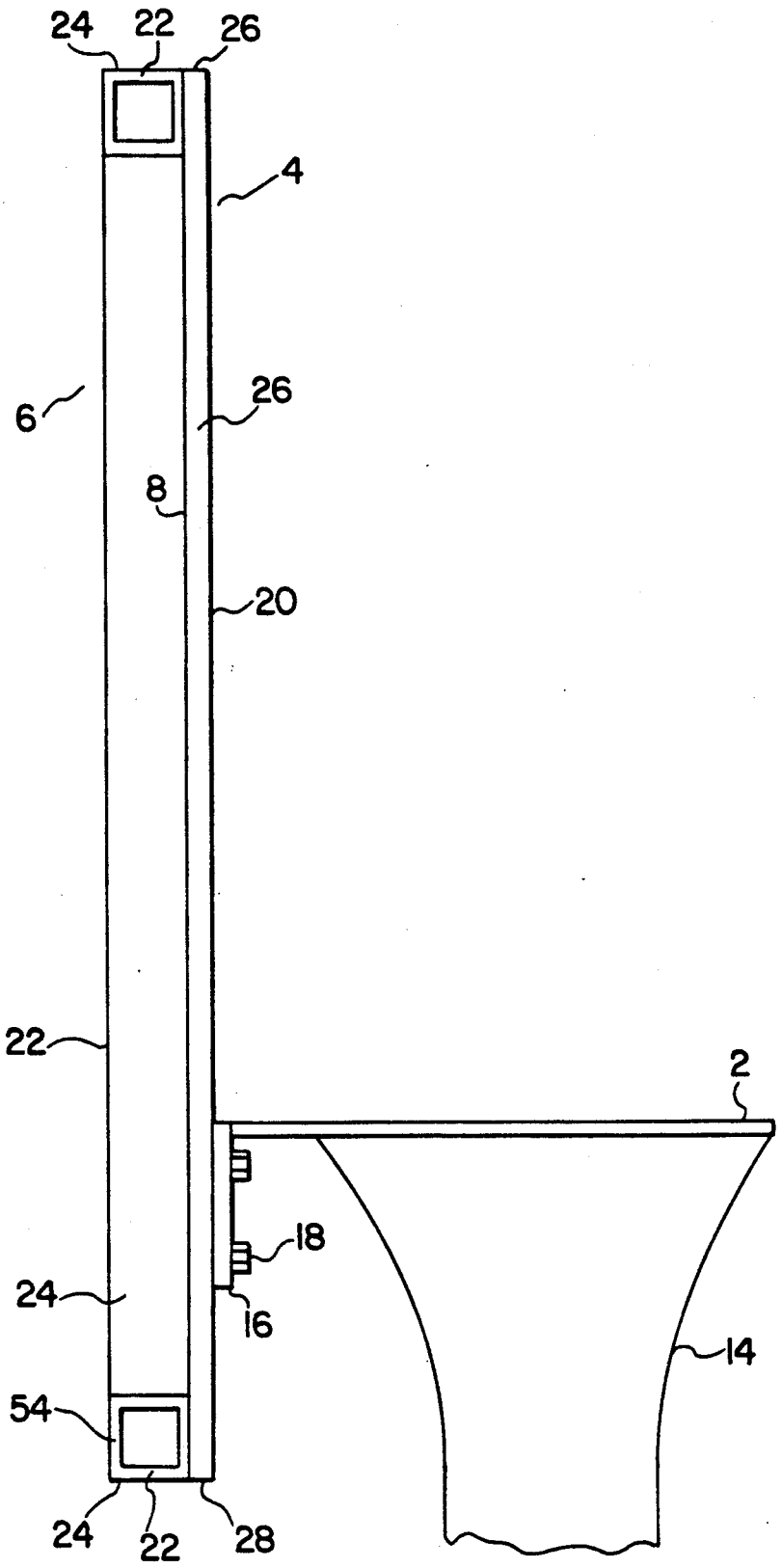
FIG. 3 is a side elevation view of the basketball backboard shown in FIG. 1 without the vinyl angle border attached thereto.
Figure 4:
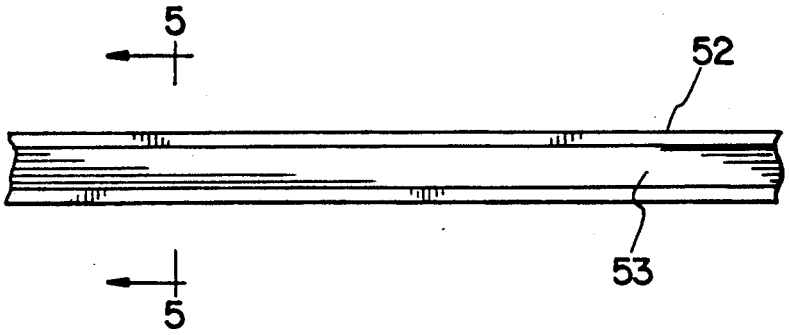
FIG. 4 is a plan view of a narrow strip of rubber having a channel therein to receive the edge of the cutout portion of the backboard in accordance with this invention.
Figure 5:
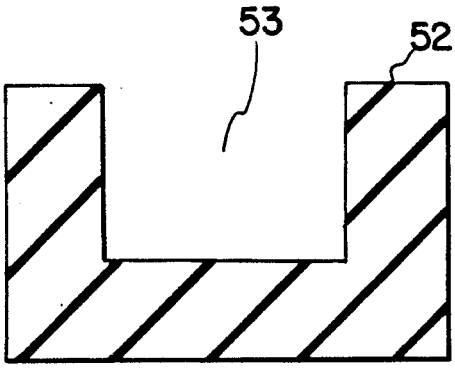
FIG. 5 is a section view taken on line 5—5 of FIG. 4.
Figure 6:
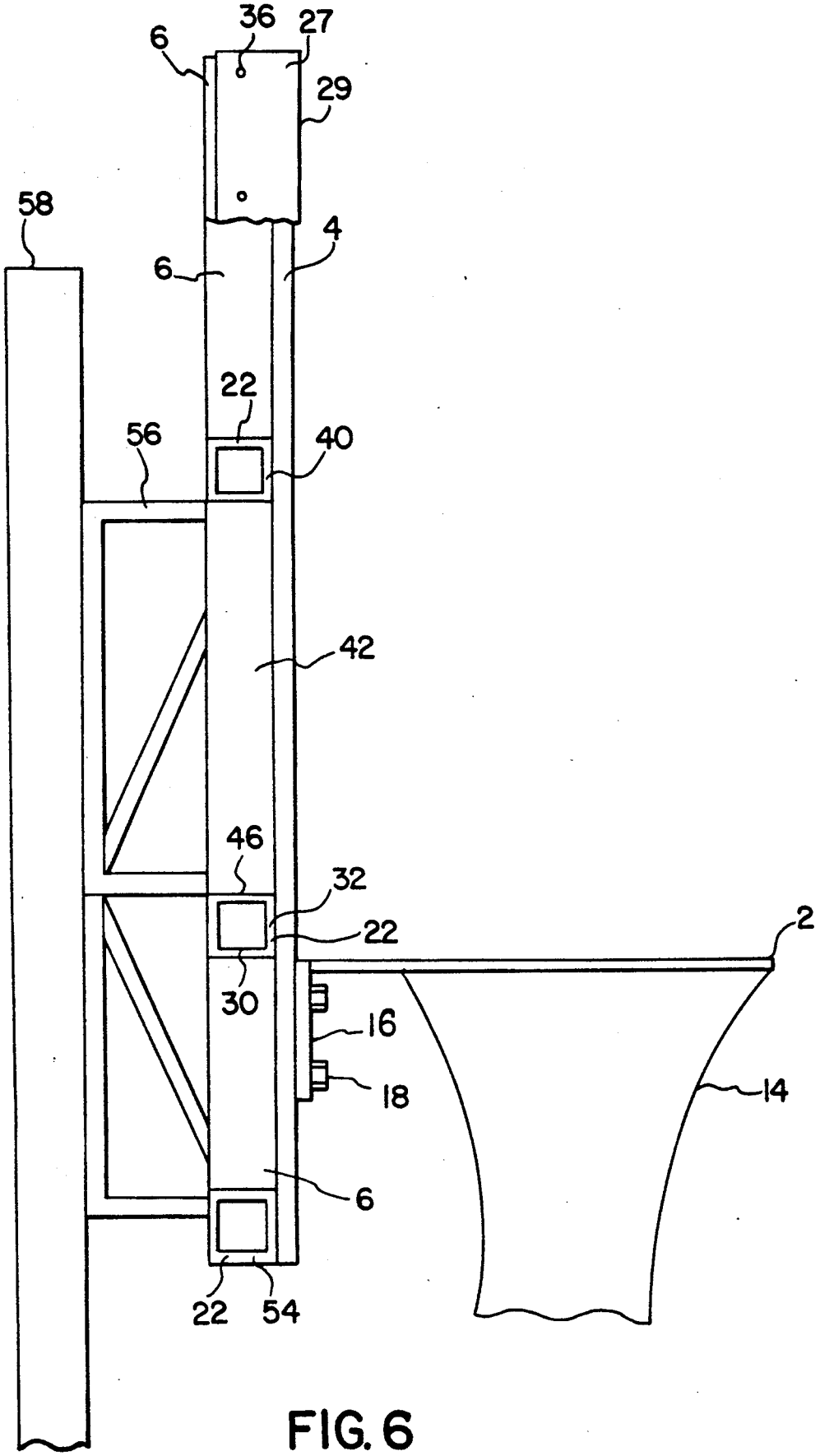
FIG. 6 is a side elevation view of the basketball backboard shown in FIG. 1 with a backboard support bracket and support pole included and a portion of the stabilizing frame cutaway thereby showing the support frame.
Figure 7:
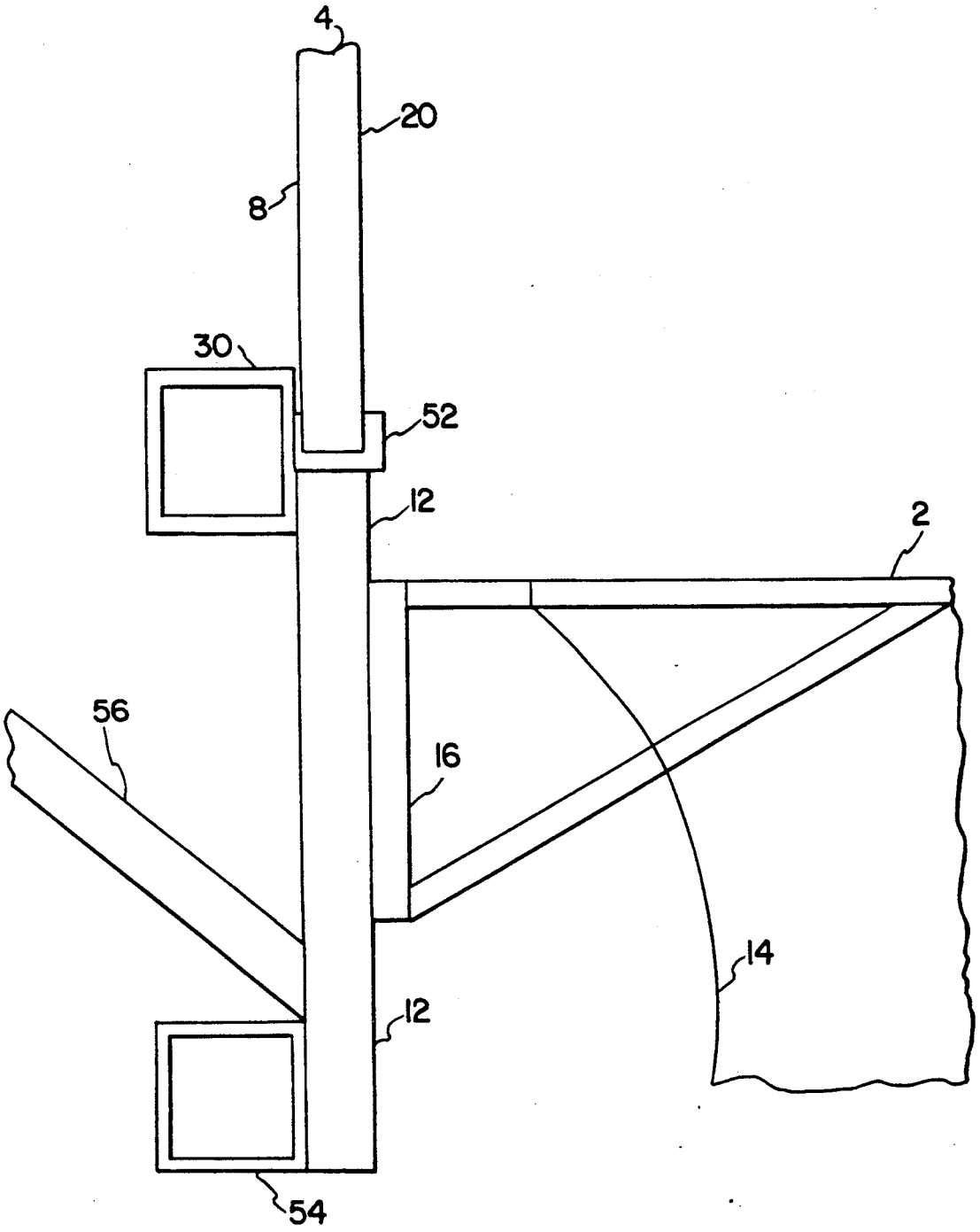
FIG. 7 is a side elevation view of the basketball rim attached to the mounting plate, and the mounting plate attached to the plate support bar and the bottom bar of the stabilizing frame. A narrow rubber strip having a channel with the edge of the cutout portion of the backboard inserted therein is shown on the top edge of the mounting plate.

An apparatus for mounting a basketball rim 2 to a glass backboard 4 in accordance with the present invention includes a stabilizing frame 6 connected to the rear wall 8 of the backboard 4, and a removed or cut out portion 10 in the backboard 4 to receive a basketball rim mounting plate 12 that supports the basketball rim 2.

The basketball rim 2 has a standard design with a net 14 hanging therefrom. A flange 16 is integrally joined to the rim 2 with the flange 16 having four orifices to receive mounting bolts 18 therethrough to connect the rim 2 to the rim mounting section 12.

The glass backboard 4 may be fabricated from plastic materials such as acrylic, polycarbonate, or vinyl, or it may be tempered glass or safety glass. The backboard 4 is rectangular in shape and has a longitudinal dimension of approximately four feet and a lateral dimension of approximately three feet with the longitudinal dimension extending in a horizontal plane. The backboard 4 has a rear wall 8 and a front wall 20 with the distance therebetween ranging between one-quarter and one-half inch.

The stabilizing member frame 6 connected to the rear wall 8 of the backboard 4 is formed from tubular metal bars 22 having a lateral dimension approximately one inch in length and a substantially square cross-section. The bars 22 are mounted along the perimeter of the rear wall 8 of the backboard 4 such that the outer side wall 24 of bars 22 are nearly flush with the edges 26 of the backboard 4. A backboard retainer member comprising vinyl angle border 27 which is secured to the outer side walls 24 of the bars 22 by utilizing mounting screws 36. The angle side 29 of the border 27 covers the periphery of the front wall 20 of the backboard 4 thereby holding the backboard 4 against the stabilizing frame 6 and retaining it in place.

The backboard 4 is not bolted to the stabilizing frame 6 nor its retainer member comprising the vinyl angle border 27. The periphery of the backboard 4 is sandwiched between the stabilizing frame 6 and the vinyl angle border 27 with the angle border 27 generating enough holding force to allow the backboard 4 to float on the stabilizing frame 6. When a basketball strikes the rim 2 or backboard 4, the floating feature reduces vibrations transmitted through the backboard 4 thereby preventing the backboard 4 from shattering.

The holding force generated by this backboard retainer member comprising the vinyl angle border 27 is developed by the distance between the angle side 29 of the angle border 27 and the front wall 20 of the backboard 4. To generate a strong holding force, the distance between the angle side 29 and the front wall 20 is decreased. To develop a lesser holding force, the distance between the angle side 29 and the front wall 20 is increased.

The vinyl angle border 27 may be fabricated from materials other than vinyl. However, the material utilized must possess characteristics that enable the angle border to compress to hold the backboard 4 against the stabilizing frame 6 thereby maintaining the position of the backboard 4 and retaining it on the frame 6. Also, the angle border 27 material must be capable of cushioning the backboard 4 to reduce vibrations induced in the backboard 4 when a basketball strikes the basketball rim 2 or the backboard 4. Further, the angle border 27 material must be capable of receiving screws therethrough when secured to the outer side walls 24 of the bars 22, and the strength of the material must prevent tearing when vibrations are induced in the backboard 4.

The compression characteristic of the angle border 27 that holds the backboard 4 against the stabilizing frame 6 allows the backboard 4 to be secured in place without having any apertures therethrough to receive bolts or other securing means to rigidly connect the backboard 4 to the peripheral stabilizing frame 6. Avoiding such rigid connections, further dampens damaging vibrations that are induced in the backboard 4.

The backboard 4 includes a small, rectangular, cut out portion 10 having a longitudinal dimension extending vertically from the lower edge 28 of the backboard 4 a distance approximately double the length of the vertical dimension of the flange 16 of the basketball rim 2. The cut out portion 10 has a lateral dimension extending horizontally a distance slightly longer than the horizontal length of the flange 1 with the mid-point of the lateral dimensions aligned with the vertical mid-section of the backboard 4.

A plate support bar 30 is mounted horizontally to the rear wall 8 of the backboard 4 with the first side wall 32 of the section support member or bar 30 having a horizontal mid-section aligned with the upper horizontal edge 34 of the cut out portion 10 of the backboard 4. The plate or section support bar 30 is mounted to the backboard 4 by utilizing a plurality of mounting screws 36 through the backboard 4 and into the section support bar 30.

A support frame 38 is mounted to the rear wall 8 of the backboard 4 above the cut out portion 10. The support frame 38 is formed from the same tubular bars 22 that form the stabilizing frame 6. The support frame 38 has a horizontal bar 40 approximately twenty inches in length with a vertical mid-section aligned with the vertical mid-section of the cut out portion 10. The horizontal bar 40 is positioned approximately fifteen inches above the plate support bar 30. Two vertical bars 42 and 44 are connected to either end of the horizontal bar 40 with the vertical bars 42 and 44 extending down to the upper wall 46 of the or section plate support bar 30. The horizontal bar 40 and vertical bars 42 and 44 are mounted to the backboard 4 by utilizing a plurality of mounting screws 36 or threaded plastic studs through the backboard 4 and into the bars thereby forming the support frame 38. A cushioning material such as rubber may be placed between the support frame 38 and the rear wall 8 of the backboard 4.

The basketball rim mounting section 12 having the basketball rim 2 connected thereto is inserted in the cut out portion 10 of the backboard 4. The mounting section 12 is a rectangular piece of plate metal having dimensions slightly less than the corresponding dimensions of the cut out portion 10 thereby allowing the plate 12 to insert therein. A narrow strip of rubber 52 having a channel 53 therein to receive the edge of the cut out portion 10, is placed between the edge of the mounting plate 12 and the edge of the cut out portion 10 thereby filling the small gaps between the mounting plate 12 and the backboard 4. The basketball rim mounting plate 12 is secured to the backboard 4 by welding the mounting plate 12 to the first side wall 32 of the plate support bar 30 and the front wall of the bottom bar 54 of the stabilizing frame 6 on the sections thereof that traverse the cut out portion 10.

A backboard support bracket 56 is secured to the horizontal and vertical bars of the stabilizing frame 38, the plate or section support bar 30 and the mounting plate 12 thereby providing stability to the assembled backboard 4 and rim 2 when a basketball strikes the front wall 20 of the backboard. Also, the support bracket 56 provides the means for mounting the backboard assembly to a support pole 58 to maintain the required height of the basketball rim 2 above a playing surface.

The mounting apparatus prevents a glass backboard 4 from shattering by isolating the basketball rim 2 from the backboard 4. The basketball rim mounting plate 12 is strong enough to support the rim 2 while a player hangs thereon to prevent the rim 2 from being torn from the backboard 4. Further, the compressive cushioning characteristics of the angle border 27 holding the backboard 4 against the stabilizing frame 6, attenuates vibrations induced in the backboard 4 from a basketball striking the rim 2 or backboard 4, or from a player violently pulling on the rim 2.

We claim:

1. An apparatus for mounting a basketball rim to a basketball backboard comprising a basketball rim mounting member, a basketball backboard having a removed portion to receive said basketball rim mounting member therein, securing means to secure said basketball rim mounting member to said backboard, mounting means to mount said basketball rim to said basketball rim mounting member, and support means to support said basketball backboard above a playing surface, wherein said securing means includes a section support member extending laterally across the back side of said backboard and in bearing contact thereagainst to provide support therefor, a stabilizing frame extending around the peripheral edge of the back side of said backboard and in bearing contact thereagainst to provide support therefor, a backboard retainer member to hold and retain said backboard in place on said stabilizing frame, and connection means to secure said basketball rim mounting member to said section support member and said stabilizing frame.

2. An apparatus for mounting a basketball rim to a basketball backboard as set forth in claim 1, wherein said section support member includes a tubular bar horizontally mounted adjacent said back side of said basketball backboard, said removed portion of said backboard opening to the bottom edge thereof and extending upwardly therefrom a distance sufficient to receive said basketball rim mounting member therein and terminating along a laterally extending upper edge, said section support member extending laterally across said back side of said backboard at the level of said laterally extending upper edge of said removed portion and on a line parallel thereto.

3. An apparatus for mounting a basketball rim to a basketball backboard as set forth in claim 1, wherein said stabilizing frame includes a plurality of tubular bars extending peripherally around said peripheral edge of said back side of said basketball backboard, said plurality of tubular bars including a lower tubular bar member extending laterally across said back side of said backboard adjacent to its said bottom edge and to said opening of said removed portion of said basketball backboard.

4. An apparatus for mounting a basketball rim to a basketball backboard as set forth in claim 1, wherein said backboard retainer member includes an angle border extending around the periphery of said backboard in each opposite direction from said opening of said removed portion to said bottom edge of said backboard, said angle border being secured to said stabilizing frame to hold said basketball backboard against said stabilizing frame.

5. An apparatus for mounting basketball rim in a basketball backboard as set forth in claim 4, wherein said angle border is manufactured from vinyl.

6. An apparatus for mounting a basketball rim to a basketball backboard, comprising a basketball rim mounting member, a basketball backboard having a removed portion to receive said basketball rim mounting member therein, securing means to secure said basketball rim mounting member to said backboard, mounting means to mount said basketball rim to said basketball rim mounting member, and support means to support said basketball backboard above a playing surface, wherein said support means includes a support member mounted to said basketball backboard, a support stand, and a connection member to connect said support member to said support stand, said securing means including a section support member extending laterally across the back side of said backboard and in bearing contact thereagainst to provide support therefor, wherein said support member includes a first tubular bar mounted to said rear wall of said backboard above said section support member, a second tubular bar mounted to one end of said first tubular bar and extending downward to said section support member, and a third tubular bar mounted to a second end of said first tubular bar and extending downward to said section support member.

* * * * *